US011421683B2

(12) United States Patent
Hurst

(10) Patent No.: US 11,421,683 B2
(45) Date of Patent: Aug. 23, 2022

(54) SYNCHRONIZED PLUNGER PACKING LUBRICATION

(71) Applicant: HALLIBURTON ENERGY SERVICES, INC., Houston, TX (US)

(72) Inventor: Justin Lee Hurst, Healdton, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 314 days.

(21) Appl. No.: 16/537,171

(22) Filed: Aug. 9, 2019

(65) Prior Publication Data

US 2021/0040945 A1 Feb. 11, 2021

(51) Int. Cl.

| | |
|---|---|
| ***F04B 53/18*** | (2006.01) |
| ***F04B 49/08*** | (2006.01) |
| ***F04B 53/02*** | (2006.01) |
| ***F04B 53/16*** | (2006.01) |
| ***E21B 41/00*** | (2006.01) |

(52) U.S. Cl.

CPC ..... *F04B 53/18* (2013.01); *F04B 49/08* (2013.01); *F04B 53/02* (2013.01); *F04B 53/164* (2013.01); *E21B 41/00* (2013.01)

(58) Field of Classification Search

CPC ..... F04B 53/02; F04B 53/164; F04B 53/18; F04B 49/08; F04B 53/143; F04B 2201/0201; F04B 2205/03

USPC ..... 417/567–569, 439; 277/318

See application file for complete search history.

(56) References Cited

U.S. PATENT DOCUMENTS

| | | | | |
|---|---|---|---|---|
| 2,711,137 A * | 6/1955 | Moller | F04B 53/164 92/153 |
| 3,602,613 A * | 8/1971 | Gunther | F04B 53/164 417/437 |
| 3,902,404 A * | 9/1975 | Breit | F16J 15/44 92/86 |
| 4,206,928 A * | 6/1980 | Asano | F16J 15/406 277/317 |
| 5,209,495 A * | 5/1993 | Palmour | F04B 53/164 277/500 |
| 5,772,216 A * | 6/1998 | Bredemeyer | F16J 15/406 277/318 |
| 6,302,401 B1 * | 10/2001 | Palmour | F04B 53/146 277/513 |
| 6,817,228 B2 * | 11/2004 | Upton | F16J 15/004 277/318 |

(Continued)

*Primary Examiner* — Alexander B Comley

(74) *Attorney, Agent, or Firm* — Haynes and Boone, LLP

(57) ABSTRACT

A high-pressure plunger pump used in the hydrocarbon industry injects pressurized lubricating fluid to the low-pressure side of a packing assembly during a suction stroke of a pump plunger in order to activate seals within the packing assembly thereby minimizing migration of working fluid along the pump plunger during the suction stroke. The system includes a pump manifold having an elongated bore in which a plunger reciprocates. A packing assembly is disposed around the plunger and includes V-shaped seals having a low-pressure end and a high-pressure end. A high-pressure lubricating fluid pump fluidly communicates with the packing assembly low-pressure end to inject pressurized lubricating fluid to the low-pressure end during a suction stroke. The pressure of the injected lubricating fluid during the suction stroke is selected to be equal to or greater than the pressure of a working fluid in the main pump housing.

20 Claims, 3 Drawing Sheets

(56) References Cited

U.S. PATENT DOCUMENTS

| | | | | |
|---|---|---|---|---|
| 9,127,577 | B2 * | 9/2015 | Donald | F04B 39/0207 |
| 9,568,101 | B2 * | 2/2017 | Hold | F16J 15/002 |
| 9,670,923 | B2 * | 6/2017 | Weaver | F16J 15/186 |
| 9,932,973 | B2 * | 4/2018 | Nakanishi | F04B 1/0448 |
| 10,167,865 | B2 * | 1/2019 | Robison | F04B 9/10 |
| 10,590,927 | B2 * | 3/2020 | Buckley | F04B 53/18 |
| 2005/0200081 | A1 * | 9/2005 | Stanton | F16J 15/183 277/510 |
| 2006/0140778 | A1 * | 6/2006 | Warren | F04B 53/08 417/53 |
| 2008/0193299 | A1 * | 8/2008 | Oglesby | F04B 15/02 417/53 |
| 2011/0239856 | A1 * | 10/2011 | Tiller | F04B 53/18 92/153 |
| 2021/0040836 | A1 * | 2/2021 | Baskin | E21B 4/003 |

* cited by examiner

SYNCHRONIZED PLUNGER PACKING LUBRICATION

FIELD OF THE INVENTION

The present invention relates generally sealing of high pressure plunger pumps used in the oil and gas industry, and more particularly to a system for maintaining an active seal of annular chevron packing stack during both the discharge and suction strokes of a plunger pump.

BACKGROUND

During the completion and/or stimulation of an oil or gas well, working fluids such as cement slurries, fracturing slurries, acids and the like are pumped under pressure into the well. Very high pressures on the order of many thousands of pounds per square inch are typically involved in these pumping operations. Additionally, the working fluids are often very abrasive because they carry large quantities of solid particles therein.

This pumping operation is typically achieved by large, positive displacement reciprocating plunger-type pumps having a reciprocating plunger deployed in a cylinder formed in the manifold of the working fluid end of a pump. Each pump cylinder is comprised of a bore with the reciprocating plunger disposed therein, which bore generally intersects or otherwise working fluidically communicates with a pump chamber. As the plunger(s) reciprocates through a retraction or intake stroke, pressure is released on an inlet check valve of a suction port and working fluid is drawn into the pump chamber from a working fluid source. As the plunger(s) reciprocates through an extension or discharge stroke, the plunger applies pressure to the working fluid. The pressurized working fluid urges the inlet check valve to close and at the same time urges an outlet check valve of a discharge port to open, allowing working fluid within the pump chamber to pass through the outlet check valve.

Typically, the seal between the reciprocating plunger and the cylinder comprises a packing stack including a plurality of V-shaped or chevron packing rings constructed of an elastomer or fabric or graphite, with various male and female adapters at the forward and rearward ends of those packing stack. A longitudinal compression is applied to the packing stack by an adjusting ring to cause the packing rings to engage the adjacent cylinder wall and the plunger. Typically, a lubrication port is provided above or upstream of the seals at the low-pressure side of the seals in order to provide lubrication to the seals as needed.

The packing stack is arranged in the stuffing box of a cylinder so that the V-shaped packing rings open in the direction of the suction and discharge ports. As such, during a discharge stroke, as the plunger is traveling towards the suction and discharge ports, the pressure of the working fluid energizes the packing rings, forcing the packing rings into tighter seals with the cylinder wall and plunger, and preventing the working fluid and abrasive materials suspended therein from migrating along the plunger body.

DESCRIPTION OF THE DRAWINGS

Numerous objects, features and advantages of the present invention will be readily apparent to those skilled in the art upon a reading of the following disclosure when taken in conjunction with the accompanying drawings.

DETAILED DESCRIPTION

Figure 1:
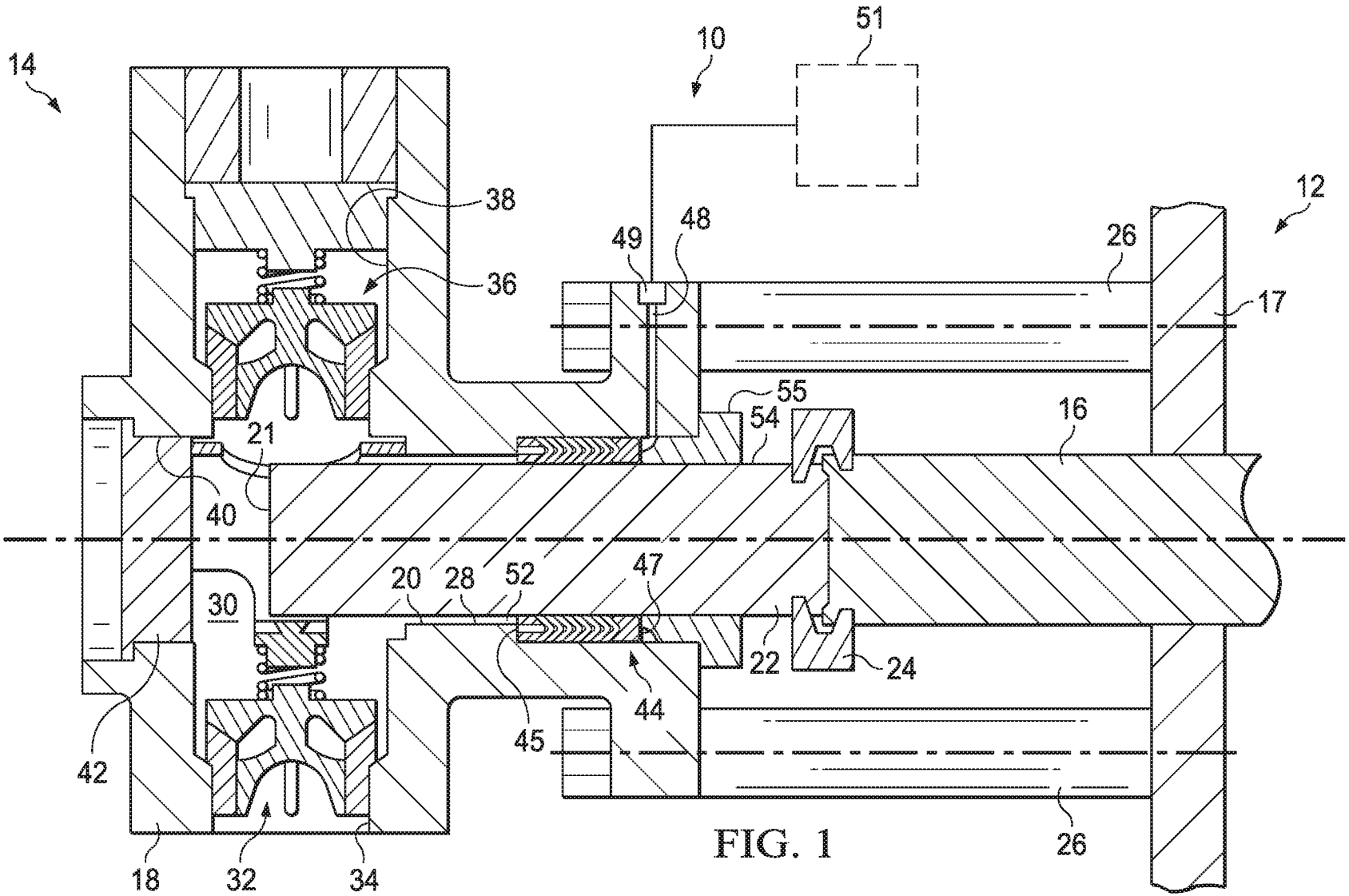
FIG. 1 is a schematic sectioned elevation view of a reciprocating plunger pump of the present disclosure.

Referring now to the drawings and particularly to FIG. 1, a portion of a reciprocating plunger pump 10 is illustrated, which plunger pump 10 generally has a power end 12 and a working fluid end 14. The power end 12 generally includes crosshead extension rods 16 extending from a crankcase housing 17, which extension rods 16 are supported by and driven by a crankshaft, piston rods, gears, bearings, etc. (not shown). The working fluid end 14 generally includes a manifold 18 in which plunger cylinder(s) 20 are formed. Each cylinder 20 is disposed for receipt of a plunger 22 which is generally coaxially attached to crosshead extension rod 16, such as by a plunger clamp 24. Spacers or stay rods 26 generally permit the working fluid end 14 to be bolted or otherwise secured to the power end 12.

Each cylinder 20 is formed of a plunger bore 28 extending in manifold 18, which cylindrical plunger bore 28 has a first end 21 and a second end 23 and generally intersects or otherwise fluidically communicates with a high-pressure pump chamber 30. An intake or suction valve 32 is mounted in a suction bore 34 communicating with the pump chamber 30, and likewise, a discharge valve 36 mounted in a discharge bore 38 communicating with pump chamber 30. In one or more embodiments, pump chamber 30 may simply be the first end of plunger bore 28, while in other embodiments, chamber 30 may be an enlarged cavity in fluid communication with or otherwise generally adjacent the first end 21 of plunger bore 28. Aligned with plunger bore 28 is an access port 40 enclosed by an access plug 42. The plunger 22 reciprocates within the manifold 18 to pump a working fluid drawn into pump chamber 30 of pump 10 through a series of inlet valves 32 and outlet valves 36 in a manner which is generally known to those skilled in the art. It will be appreciated that as described, pump 10 can be any reciprocating plunger pump and particularly may be a reciprocating plunger pump for pumping cement slurries, fracturing slurries, acids and the like for completion and stimulation of an oil or gas well. Thus, the specification is not limited to a particular type of plunger pump.

Disposed along plunger bore 28 is a packing assembly 44 having a high-pressure end 45 and a lower pressure end 47. The packing assembly 44 is shown in place within an annular space 52 defined between a radially outer surface 54 of a pump plunger 22 and cylindrical plunger bore 28 of pump manifold 18. A gland nut 55 secures packing assembly 44 within annular space 52.

At least one lubricating fluid passage 48 extends from a lubricating fluid port 49 in manifold 18 where lubricating fluid passage 48 is in fluid communication with the low-pressure end 47 of packing assembly 44. In one or more embodiments, lubricating fluid passage 48 is adjacent the lower pressure end 47 of packing assembly 44. As described in more detail below, a lubricating fluid supply system 51 is in fluid communication with the lubricating fluid port 49 to intermittently supply lubricating fluid to the low-pressure end 47 of packing assembly 44 during each retraction stroke of plunger 22. In one or more embodiments, the lubricating fluid is oil. In one or more embodiments, the lubricating fluid is grease.

Figure 2B:
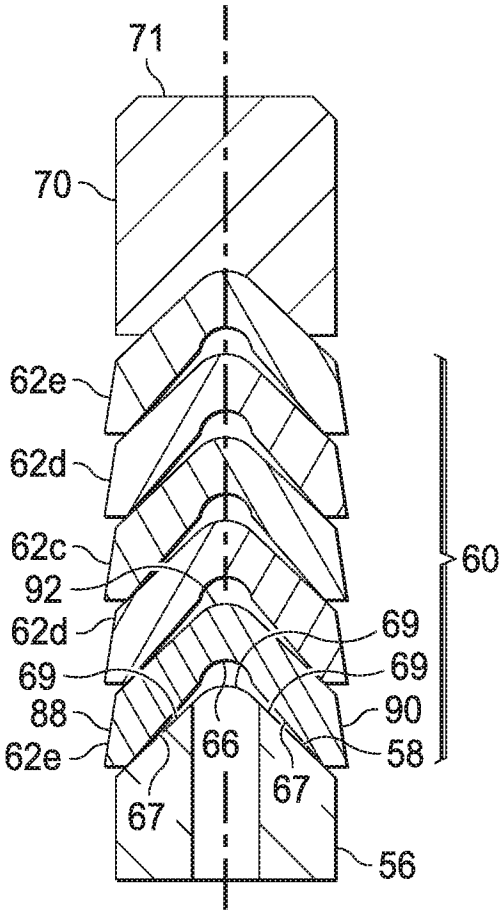
FIG. 2B is a partial, sectioned view of the packing assembly of FIG. 2A.
Figure 2A:
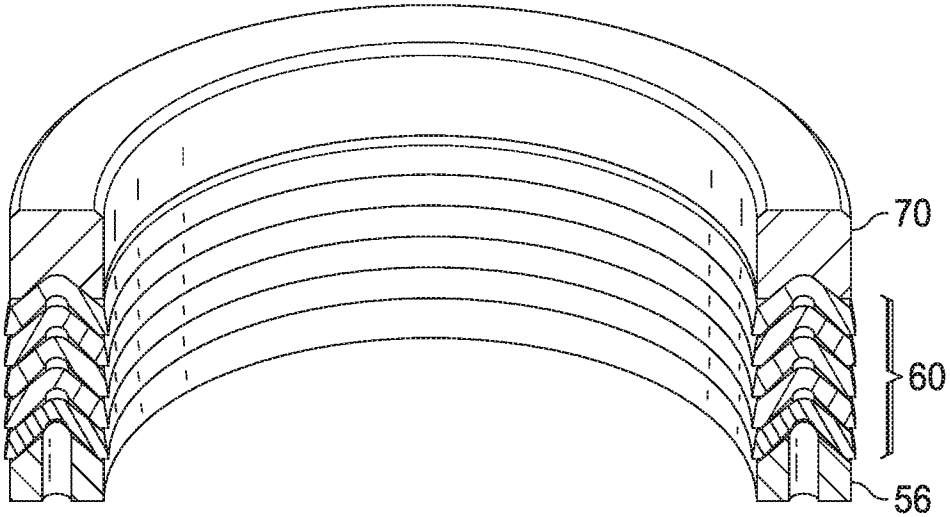
FIG. 2A is a schematic sectioned elevation view of a packing assembly as used in the plunger pump of FIG. 1.

With reference to FIGS. 2A and 2B, the packing assembly 44 is illustrated in greater detail. In one or more embodiments, the packing assembly 44 may include a header ring 56 disposed in the annular space 52 ahead of and engaging a packing ring stack 60. Packing assembly 44 includes a packing ring stack 60. Packing ring stack 60 is shown as including at least one sealing element 62, which in one or more embodiments, is a V-shaped or chevron shaped packing ring 62. In one or more embodiments, packing ring stack 60 includes a plurality of adjacent sealing elements 62, such as V-shaped or chevron shaped packing rings 62*a*, 62*b*, 62*c*, 62*d* and 62*e* which are disposed to nest with each other as shown. Each V-shaped packing ring 62 generally is defined by a radially inner leg 88 and a radially outer leg 90. The legs 88 and 90 are joined together at their rearward ends as at 92 to form a concave side 66 defined by forward surfaces 67 of the radially inner and outer legs 88 and 90, while a convex side 68 of packing ring 62 is defined by rearward surfaces 69 of the radially inner and outer legs 88 and 90.

The concave side 66 of first V-shaped packing ring 62*a* is adjacent and facing the rearward end 58 of header ring 56. In one or more embodiments, the rearward end 58 of header ring 56 may be shaped to engage the concave side 66 of packing ring 62*a*.

In one or more embodiments, one or more of the packing rings 62 may be conventional elastomeric packing rings. While some embodiments of the invention are not limited to a particular packing rings 62, in other embodiments of the invention, packing rings 62 are preferably of a type that tend to flex radially outward upon a plunger extension and flex radially inward upon a plunger retraction. In this regard, one such type of packing ring is the chevron or V-shaped packing rings as shown in FIG. 2.

A backing ring 70 is disposed in the annular space 52 behind the last V-shaped packing ring 62 of packing ring stack 60.

The header ring 56 provides longitudinal support of the forward packing ring 62*a* against forward extension thereof when pump plunger 22 reciprocates forward relative to pump manifold 18. Similarly, the backing ring 70 provides longitudinal support of the last packing ring 62*e* against reward extension thereof when pump plunger 22 reciprocates back relative to pump manifold 18.

In one or more embodiments, the packing stack 60 may include additional rings disposed in the annular space 52, such as anti-extrusion rings (not shown) abutting the first and/or last packing rings 62, or additional sealing rings (not shown).

It will be appreciated that upon forward reciprocation of pump plunger 22 relative to pump manifold 18, working fluid pressure within pump chamber 30 increases. This increased working fluid pressure impinges on the concave side 66 of each packing ring 62 and in particular, to the forward surfaces 67 so as to force legs 88 and 90 radially apart from one another and into sealing engagement with the radially outer surface 54 of pump plunger 22 and the cylindrical plunger bore 28, respectively.

Figure 3:
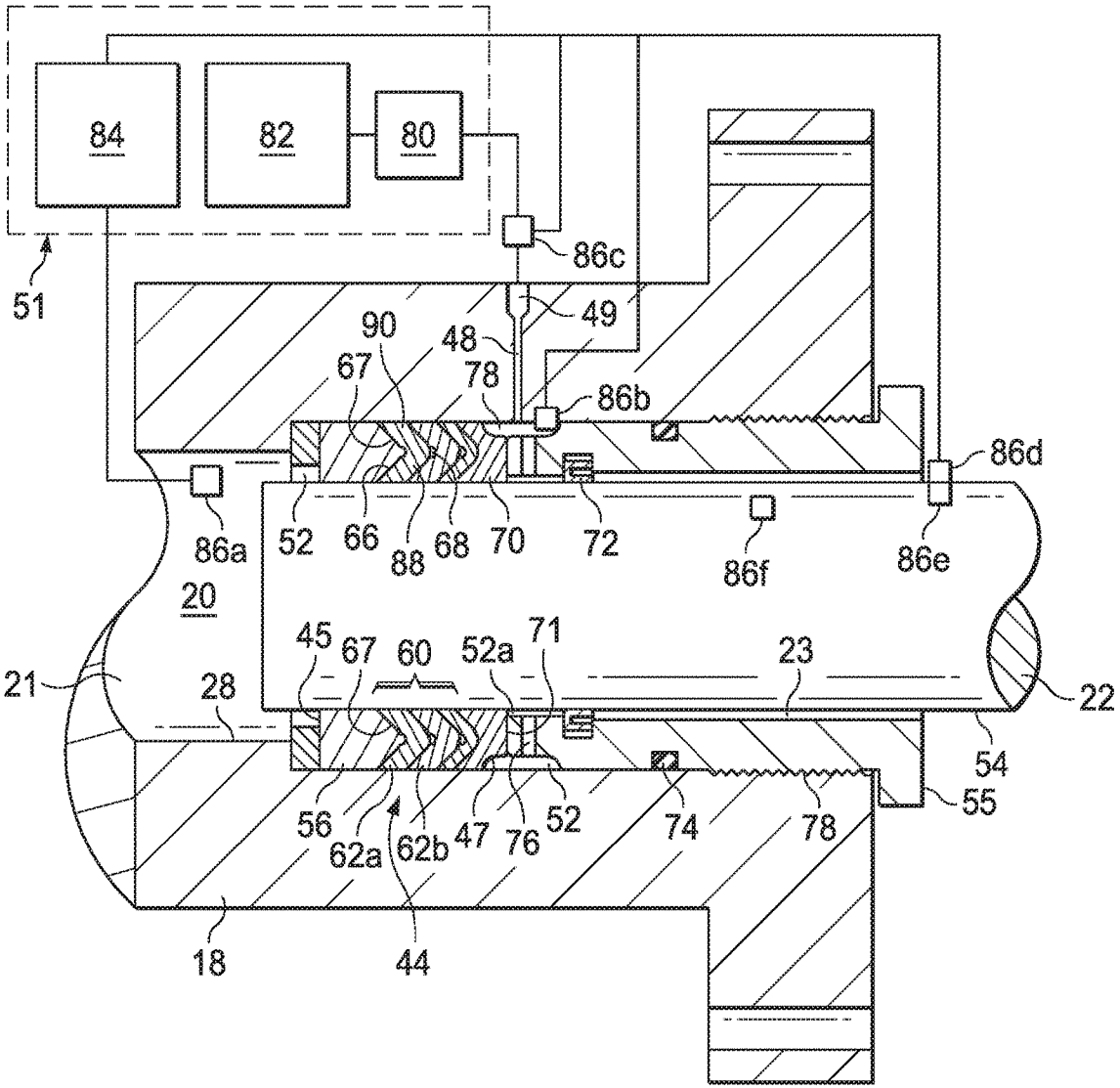
FIG. 3 is a schematic sectioned elevation view of the stuffing box of the plunger pump of FIG. 1.

As best seen in FIG. 3, gland nut 55 extending into the annular space 52 to compressed packing ring stack 60. In one or more embodiments, gland nut 55 is disposed directly behind and engages a rear end 71 of backing ring 70. Although gland nut 94 can be any fastener that secures packing ring stack 60 and other components of packing assembly 44 within annular space 52. In one or more embodiments, gland nut 55 may include inner and outer seals 72 and 74 for sealing against plunger 22 and cylindrical plunger bore 28 of pump manifold 18, respectively. Likewise, gland nut 55 may include an lubricating fluid duct 76 disposed therethrough for conducting lubricating fluid from lubricating fluid supply system 51 to the pump plunger 22 for lubricating the pump plunger 22 along the area of sealing engagement with the packing assembly 44. Gland nut 55 may be threaded at 78 as shown to permit attachment of gland nut 55 to manifold 18 and for thereby adjusting a longitudinal compression of the remaining components of packing assembly 44.

In one or more embodiments, a lubricating cavity 78 may be formed behind or on the low-pressure side of packing stack 60 in the annular space designated as 52*a*. In the illustrated embodiment, lubricating cavity 78 is formed adjacent backing ring 70 at rear end 71 of backing ring 70.

In the packing assembly 44, a high sealability against leakage of working fluid from high-pressure pump chamber 30 is provided by the radial compression of packing rings 62.

The V-shaped packing rings 62 achieve their sealing effect due to being pressure-energized to spread the legs 88, 90 of the V-shaped packing ring 62 so as to seal the ends of those legs 88, 90 against the pump plunger 22 and the plunger bore 28, respectively.

In one or more embodiments, lubricating fluid supply system 51 includes a high pressure lubricating pump 80 in fluid communication with lubricating fluid port 49, a lubricating fluid reservoir 82 in fluid communication with lubricating pump 80 and a controller 84 coupled to lubricating pump 80. In one or more embodiments, controller 84 is coupled to one or more of sensors 86 and configured to control the supply of lubricating fluid to annular space 52 during suction strokes of plunger 22. As described herein, it will be appreciated that high pressure lubricating pump 80 is capable of pressurizing lubricating fluid pumped therethrough to a pressure that is at least within the general range of the pressurized working fluid within the plunger pump 10. In one or more embodiments, high pressure lubricating pump 80 must be capable of achieving lubricating fluid pressures that equal or exceed a fluid pressure of the pressurized working fluid within chamber 30. In many cases, the working fluid is pressurized to between 9000 PSI and 15,000 PSI. In some cases, working fluid may be pressurized to at least 9000 PSI. In some cases, working fluid may be pressurized to 15,000 PSI or more. Lubricating pump 80 must be capable of pressurizing lubricating fluid accordingly to approximately equal if not exceed the pressure of the working fluid. Thus, in one or more embodiments, lubricating fluid may be injected at a pressure of at least 8,000 PSI; while in other embodiments, lubricating fluid may be injected at a pressure within a range of 9,000 PSI to 15,000 PSI. Where working fluid pressures are 15,000 PSI or higher, then pump 80 must likewise be capable of pressurizing lubricating fluid to at least 14,000 PSI.

In one or more embodiments, sensors 86 measure a pressure of working fluid within working fluid chamber 30 or at the high-pressure end 45 of packing assembly 44. In one or more embodiments, sensors 86 measure a position of plunger 22 relative to manifold 18. Persons of skill in the art will appreciate that the disclosure is not limited to a particular type of sensor. In some embodiments, sensor 86 may be a pressure sensor 86*a*, as illustrated, deployed on the high-pressure or working fluid side of plunger 22 to measure the pressure of working fluid within working fluid chamber 30 as plunger 22 translates through its compression and suction strokes. In some embodiments, pressure sensors 86*b* and/or 86*c* may be deployed on the low-pressure side of packing assembly 44 and utilized in conjunction with pressure sensor 86*a* to monitor or measure a pressure difference, which can then be utilized by controller 84 as a basis for activating pump 80 in order to increase lubricating fluid pressure within annulus 52*a* in order to ensure packing ring(s) 62 continue to seal as desired. Alternatively, or in addition to pressure sensors, one or more position sensor(s) 86*d*, 86*e*, 86*f* may be deployed along plunger 22 to measure the relative position of plunger 22 within cylinder 20 as plunger 22 translates through its compression and suction strokes. In some embodiments, position sensor 86*d* is a limit switch.

As explained above, during a compression stroke of plunger 22, the pressure of working fluid within pump chamber 30 increases so as to energize packing rings 62 into sealing engagement with the plunger 22 and bore 28, thereby preventing the flow of working fluid and particulate matter along plunger 22 from the high-pressure end 45 of packing assembly 44 towards the low-pressure end 47 of packing assembly 44. However, it will be appreciated that during a suction stroke, the pressure of the working fluid within pump chamber 30 decreases. This may result in packing rings 62 becoming "de-energized" and release of the sealing engagement of rings 62 within annular space 52. To maintain packing rings 62 in an energized state during a suction stroke of plunger 22, controller 84 activates lubricating pump 80 to provide pressurized lubricating fluid to annular space 52*a* behind ring stack 60. Thus, pressurized lubricating fluid may be injected into lubricating cavity 78 adjacent backing ring 70, or more broadly to the convex side(s) 68 of packing rings 62. In one or more embodiments, lubricating pump 80 intermittently injects pressurized lubricating fluid into annular space 52*a* during each retraction or suction stroke of plunger 22. In this regard, in some embodiments, pressure sensor 86*a* measures the pressure of working fluid within pump chamber 30 or otherwise within bore 28 adjacent the high-pressure end 45 of packing assembly 44. When the measured pressure drops below a predetermined threshold, and is therefore indicative that plunger 22 is in a retraction stroke, then lubricating pump 80 is activated by controller 84 and injects pressurized lubricating fluid into annular space 52*a*. In other embodiments, position sensor 86*d* measures the position of plunger 22 within cylinder 20. When the position of plunger 22 indicates it is in a retraction stroke, then lubricating pump 80 is activated by controller 84 and injects pressurized lubricating fluid into annular space 52*a*. While position sensor 86*d* is not limited to any particular type, in some embodiments, position sensor 86*d* may be a limit switch. In other embodiments, other sensors, such as sensors 86*e* and/or 86*f*, may likewise be utilized to indicate a retraction stroke of plunger 22, thereby triggering pump 80 to inject pressurized lubricating fluid into annular space 52*a* as described.

In still yet other embodiments, rather than relying on one or more sensors 86 to indicate retraction of plunger 22, controller 84 may simply provide an injection of pressurized lubricating fluid at time increments selected to correspond with the retraction of plunger 22 within cylinder 20.

In any event, it will be appreciated that in one or more embodiments, the injection of lubricating fluid into annular space 52*a* is intermittent and occurs only during all or a portion of a retraction stroke of plunger 22. As such, during such each retraction stroke of plunger 22, an additional compressive force is placed on ring stack 60 from the low-pressure end 47 of packing assembly 44, thereby urging packing rings 62 into sealing engagement within the sealing surface 54 of plunger 22 and the sealing surface of plunger bore 28 within annular space 52.

In one or more embodiments, the pressure of lubricating fluid injected into annular space 52*a* is selected to be equal to or greater than the pressure of working fluid within pump chamber 30 or otherwise within bore 28 adjacent the high-pressure end 45 of packing assembly 44. As such, even if packing rings 62 are not fully energized into sealing engagement within annular space 52, the balanced or positive net working fluid pressure within annular space 52 prevents migration of working fluid from pump chamber 30 along bore 28 towards the low-pressure end 47 of packing assembly 44. Thus, in one or more embodiments, pressure sensor 86*a* may be used measure working fluid pressure within pump chamber 30 (or otherwise within bore 28 adjacent the high-pressure end 45 of packing assembly 44) and controller 84 can be used to ensure that the pressure of injected pressurized lubricating fluid is equal to or greater than the working fluid pressure measured by pressure sensor 86*a*.

Figure 4:
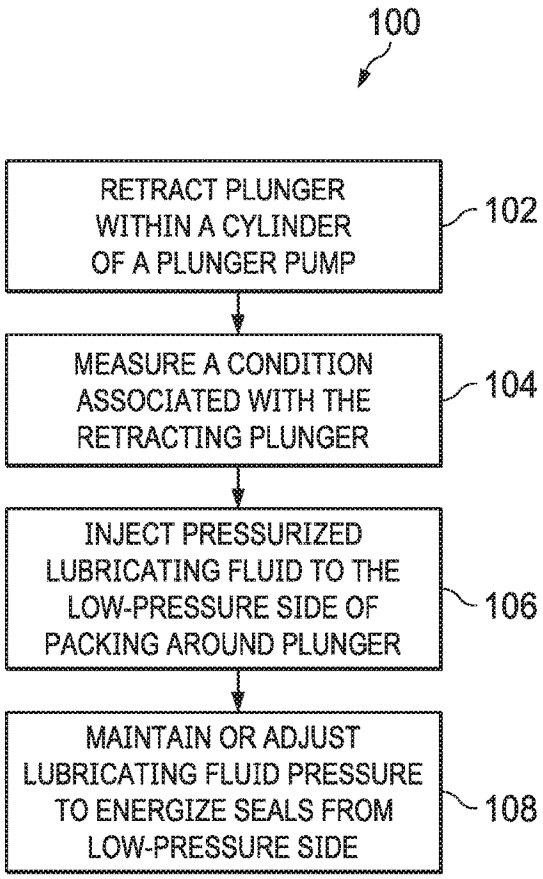
FIG. 4 is a flowchart for a method of operating a plunger pump.

Turning to FIG. 4, a method 100 for operating an oil and gas plunger pump, such as a hydraulic fracturing of chemical injection pump, to pump a working fluid is illustrated. In a first step 102, the plunger 22 of a plunger pump 10 is retracted in a suction stroke to draw a working fluid into the plunger pump 10. Specifically, the plunger 22 is retracted in a plunger cylinder. During at least a portion of the suction stroke, in step 104, a condition associated with the plunger is measured to trigger injection of lubricating fluid into the cylinder based on the measured condition. In some embodiments, the pressure of a working fluid within pump chamber 30 (or otherwise within bore 28 adjacent the high-pressure end 45 of packing assembly 44) may be measured, with a pressure drop of the working fluid being indicative of a suction stroke, thereby triggering lubricating fluid injection. In some embodiments, the position of a plunger 22 within cylinder 20 may be used to identify a suction stroke, thereby triggering lubricating fluid injection. For example, a change in direction of the plunger from a first direction to an opposite second direction may trigger lubricating fluid injection. Similarly, the triggering of one or more plunger position limit switch(s) associated with the plunger may trigger lubricating fluid injection. Thus, lubricating fluid injection may be triggered when the plunger 22 reaches a predetermined position in cylinder 20 indicative of a maximum extension of the plunger within the plunger cylinder during a working fluid compression stroke. In other embodiments, an additional limit switch may be utilized to identify maximum retraction of the plunger 22 within the plunger cylinder 20 during a working fluid suction stroke.

In step 106, based on the measured condition, pressurized lubricating fluid is injected into the annulus around the plunger 22 on the low-pressure side of the packing ring stack 60. For example, pressurized lubricating fluid is injected adjacent backing ring 70 or otherwise into annular space or cavity 52*a*. In one or more embodiments, pressurized lubricating fluid is injected during the entire suction stroke. In other embodiments, pressurized lubricating fluid is injected at least during a portion of the suction stroke, such as the end of the suction stroke as packing rings 62 become less energized. Similarly, in some embodiments, the pressurized lubricating fluid is injected continuously during the suction stroke, while in other embodiments, the pressurized lubricating fluid may be injected intermittently during the suction stroke. In any event, the pressure of the lubricating fluid is selected to prevent working fluid migration within plunger cylinder 20 from the high-pressure end 45 of packing assembly 44 towards the low-pressure end 47 of packing assembly 44 along plunger 22.

In one or more embodiments, the pressure of the injected lubricating fluid is selected to activate one or more packing rings 62, thereby urging the activated sealing rings into sealing engagement within the annulus around plunger 22. The packing ring(s) 62 are activated from a first side or low-pressure side. In one or more embodiments, the activated packing rings 62 may be V-shaped rings and activation forces legs of the V-shaped packing rings 62 radially outward.

In one or more embodiments, the pressure of the injected lubricating fluid is selected to be equivalent to the pressure of working fluid within pump chamber 30 or cylinder 20 at the high-pressure end 45 of a packing assembly 44. In this regard, such working fluid pressure within pump chamber 30 may change during the retraction stroke, and thus, the pressure of the injected lubricating fluid may correspondingly be adjusted to maintain an equilibrium balance between working fluid pressure within the pump chamber and the lubricating fluid. This prevents working fluid from within the pump chamber 30, and any particulates suspended in the working fluid, from migrating along pump cylinder 20 towards the low-pressure end 47 of the packing assembly 44.

In one or more embodiments, the pressure of the injected lubricating fluid is selected to be greater than the pressure of working fluid within pump chamber 30 or high-pressure end of cylinder 20, so as to maintain a positive working fluid pressure within annular space or cavity 52*a* relative to the working fluid pressure within pump chamber 30. In this regard, such working fluid pressure within pump chamber 30 may change during the retraction stroke, and thus, the pressure of the injected lubricating fluid may correspondingly be adjusted to maintain a desired positive pressure between working fluid pressure within the pump chamber and the lubricating fluid. This prevents working fluid from within the pump chamber, and any particulates suspended in the working fluid, from migrating along pump cylinder 20 towards the low-pressure end 47 of the packing assembly 44.

In step 108, as the plunger 22 proceeds to its compression stroke, the pressure of the injected lubricating fluid is maintained, altered or adjusted as necessary to ensure that either the sealing elements remain energized from the low pressure side or that the lubricating fluid pressure on the low pressure side of the seals is equal to or greater than the working fluid pressure. In one or more embodiments, it is desirable to maintain the lubricating fluid at a pressure great enough to keep seal rings energized from the low-pressure end of the packing stack even as the working fluid pressure that energizes the seal rings form the high-pressure end of the packing stack decreases. Alternatively, the it is desirable to ensure that the lubricating fluid pressure is equal to or greater than the pressure of the working fluid. In either case, injection of the pressurized lubricating fluid is altered or adjusted or maintained to achieve this outcome. In one or more embodiments of step 108, pressurized lubricating fluid injection is suspended, while in other embodiments of step 108, the pressure of lubricating fluid injected into annular space 52*a* may be decreased. In some embodiments, the pressure of lubricating fluid injected into annular space 52*a* (or otherwise within bore 28 adjacent the low-pressure end 47 of packing assembly 44) may be gradually decreased based on the degree of the compression stroke. Thus, as plunger 22 moves from the beginning of the compression stroke towards full extension, the pressure of injected lubricating fluid is gradually decreased since the pressure of the working fluid gradually increases to activate packing rings 62 from the high-pressure end 45 of packing assembly 44.

Where lubricating fluid injection is suspended, in one or more embodiments, pressurized lubricating fluid injection is suspended at the point of full retraction of the plunger 22 between the suction and compression strokes. In one or more embodiments, pressurized lubricating fluid injection is suspended at the end of the suction stroke as the plunger 22 prepares to change from movement from a second suction direction to movement in a first compression direction. In one or more embodiments, pressurized lubricating fluid injection is suspended at the beginning of the compression stroke after the plunger 22 has change from movement in a second suction direction to movement in a first compression direction.

Where the pressure of injected lubricating fluid is decreased, in one or more embodiments, lubricating fluid pressure begins to be decreased at the point of full retraction of the plunger 22 between the suction and compression strokes. In one or more embodiments, lubricating fluid pressure begins to be decreased at the end of the suction stroke as the plunger 22 prepares to change from movement from a second suction direction to movement in a first, opposite direction. In one or more embodiments, lubricating fluid pressure begins to be decreased at the beginning of the compression stroke after the plunger 22 has change from movement in a second suction direction to movement in a first compression direction.

Thus, in some embodiments, injection of pressurized lubricating fluid is dynamic, whereby the pressure of the injected lubricating fluid changes through the progression of the suction stroke. In one or more embodiments, a predetermined pressure differential may be selected and maintained between the working fluid pressure and the injected pressurized lubricating fluid during the suction stroke. In some embodiments, the pressure differential may be approximately zero, such that the pressure of the injected lubricating fluid substantially equals the pressure of the working fluid. In other embodiments, the pressure of the injected lubricating fluid is maintained at a pressure selected to be higher than the pressure of the working fluid.

Thus, in some embodiments, controller 84 may measure a condition associated with plunger 22 in real time and adjust the pressure of injected lubricating fluid in real time to achieve the desired goal of inhibiting migration of working fluid along plunger cylinder 20 and plunger 22. In this regard, controller 84 may either maintain a neutral pressure gradient between the injected lubricating fluid pressure and the working fluid pressure during at least a portion, and in some embodiments, substantially all, of the suction (retraction) stroke; or maintain the lubricating fluid pressure at an increased pressure relative to the working fluid pressure during at least a portion, and in some embodiments, substantially all, of the suction (retraction) stroke.

Thus, a plunger pump for use with hydrocarbon wells has been described. The plunger pump generally includes a pump manifold having a working fluid inlet, a working fluid outlet, and an elongated bore formed in the pump manifold, the elongated bore having a first end and a second end, the second end of the bore in fluid communication with the working fluid inlet; an elongated plunger having a first end and a second end, the plunger slidingly disposed within the bore so as to define an annulus between the bore and the plunger; a packing assembly disposed in the annulus between the plunger and the bore, the packing assembly having a low-pressure end closest to the first end of the bore and a high-pressure end closest to the second end of the bore; a lubricating fluid port in fluid communication with the low-pressure end of the seal assembly; a high pressure lubricating fluid pump in fluid communication with the lubricating fluid port; and a controller operably coupled to the plunger and to the lubricating fluid pump. In other embodiments, the plunger pump includes a pump manifold having a working fluid inlet, a working fluid outlet, and an elongated bore formed in the pump manifold, the elongated bore having a first end and a second end, the second end of the bore in fluid communication with the working fluid inlet; an elongated plunger having a first end and a second end, the plunger slidingly disposed within the bore so as to define an annulus between the bore and the plunger; a packing assembly disposed in the annulus between the plunger and the bore, the packing assembly having a low-pressure end closest to the first end of the bore and a high-pressure end closest to the second end of the bore, the packing assembly comprising a plurality of V-shaped packing rings abutting one another to form a packing ring stack, each V-shaped packing ring having a first leg and a second leg joined together at their rearward ends to form a concave side of the packing ring and a convex side of the packing ring, wherein the concave side of the packing ring faces the high-pressure end of the packing assembly and the convex side of the packing ring faces the low-pressure end of the packing assembly; a sensor disposed to measure a condition associated with the plunger; a lubricating fluid port in fluid communication with the low-pressure end of the seal assembly; a high pressure lubricating fluid pump in fluid communication with the lubricating fluid port; and a controller operably coupled to the sensor and to the lubricating fluid pump.

For any one of the foregoing embodiments, the following elements may be combined alone or in combination with other elements:

- A first pressure sensor disposed within the pump adjacent the first end of the elongated bore, wherein the controller is electrically coupled to the first pressure sensor.
- A second pressure sensor associated with the second end of the packing assembly, wherein the controller is electrically coupled to the second pressure sensor.
- A first position sensor disposed along the plunger, wherein the controller is electrically coupled to the first position sensor.
- A limit switch disposed along the plunger, wherein the controller is electrically coupled to the limit switch.
- A lubricating fluid reservoir in fluid communication with the high pressure lubricating fluid pump.
- A first pressure sensor disposed to measure a working fluid pressure at the first end of the packing assembly and a second pressure sensor disposed to measure lubricating fluid pressure at the second end of the packing assembly.
- A first pressure sensor disposed to measure a first fluid pressure at the first end of the packing assembly and a second pressure sensor disposed to measure a second fluid pressure at the second end of the packing assembly, wherein the first fluid is a working fluid and the second fluid is oil or grease.
- The packing assembly comprises at least one V-shaped packing ring, the V-shaped packing ring having a first leg and a second leg joined together at their rearward ends to form a concave side of the packing ring and a convex side of the packing ring.
- The packing assembly comprises a plurality of V-shaped packing rings abutting one another to form a packing ring stack.
- The concave side of the packing ring faces the high-pressure end of the packing assembly and the convex side of the packing ring faces the low-pressure end of the packing assembly.
- The packing assembly further comprises a header ring at the high-pressure end of the packing assembly and a backing ring at the low-pressure end of the packing assembly, with one or more V-shaped packing ring between the header ring and the backing ring.
- The sensor is selected of the group consisting of a pressure sensor, a position sensor and a limit switch associated with the plunger.

Likewise, a method of operating a plunger pump to pressurize a working fluid has been described. The method includes the steps of moving a plunger through compression and suction strokes; measuring a condition associated with the plunger during the suction stroke; based on the measured condition, injecting a pressurized lubricating fluid to the low-pressure side of a seal assembly disposed along the plunger, wherein the pressure of the injected lubrication fluid is selected to be at least substantially equal to the pressure of a working fluid adjacent the high-pressure side of the seal assembly.

For embodiments of the foregoing method, the following steps may be included, alone or in combination with any other steps:

- Adjusting the pressure of the injected pressurized lubricating fluid during at least a portion of a suction stroke.
- Utilizing the pressurized lubricating fluid activate the seal assembly from the low-pressure side of the seal assembly, thereby enhancing sealing by the seal assembly during the suction stroke.
- Measuring the pressure of the working fluid during the suction stroke and dynamically adjusting the pressure of the lubricating fluid during substantially all of the suction stroke to maintain the injected lubricating fluid pressure to be at least equal to the working fluid pressure during the suction stroke.
- During a plurality of compression and suction strokes, initiating injection of pressurized lubricating fluid at the beginning of each suction stroke and terminating injection of pressurized lubricating fluid at the beginning of each compression stroke.
- Initiating injection of pressurized lubricating fluid based on timed intervals corresponding to a plunger stroke.
- Terminating injection of pressurized lubricating fluid based on timed intervals corresponding to a plunger stroke.
- Initiating injection of pressurized lubricating fluid based on the position of the plunger during a plunger stroke.
- Terminating injection of pressurized lubricating fluid based on the position of the plunger during a plunger stroke.
- Initiating injection of pressurized lubricating fluid based on the pressure of the working fluid.
- Terminating injection of pressurized lubricating fluid based on the pressure of the working fluid.
- Initiating injection of pressurized lubricating fluid based on activation of a switch associated with the plunger.
- Terminating injection of pressurized lubricating fluid based on activation of a switch associated with the plunger.

Thus, it is seen that the apparatus of the present invention readily achieves the ends and advantages mentioned as well as those inherent therein. While certain preferred embodiments of the present invention have been illustrated for the purposes of this disclosure, numerous changes in the arrangement and construction of parts may be made by those skilled in the art, which changes are encompassed within the scope and spirit of the present invention as defined by the appended claims.

The invention claimed is:

1. A plunger pump for use with hydrocarbon wells, the plunger pump comprising:

a pump manifold having a working fluid inlet, a working fluid outlet, and an elongated bore formed in the pump manifold, the elongated bore having a first end and a second end, the first end of the bore in fluid communication with the working fluid inlet;

an elongated plunger having a first end and a second end, the plunger slidingly disposed within the bore so as to define an annulus between the bore and the plunger;

a packing assembly disposed in the annulus between the plunger and the bore, the packing assembly having a low-pressure end closest to the second end of the bore and a high-pressure end closest to the first end of the bore;

a lubricating, fluid port in fluid communication with the low-pressure end of the packing assembly;

a high pressure lubricating fluid pump in fluid communication with the lubricating fluid port; and a controller operably coupled to the lubricating fluid pump to intermittently initiate injection of pressurized lubricating fluid only during intervals corresponding to a suction stroke of the plunger.

2. The plunger pump of claim 1, further comprising a first pressure sensor disposed within the pump adjacent the first end of the elongated bore, wherein the controller is electrically coupled to the first pressure sensor.

3. The plunger pump of claim 2, further comprising a second pressure sensor associated with the low-pressure end of the packing assembly, wherein the controller is electrically coupled to the second pressure sensor.

4. The plunger pump of claim 1, further comprising a first position sensor disposed along the plunger, wherein the controller is electrically coupled to the first position sensor.

5. The plunger pump of claim 1, further comprising a limit switch disposed along the plunger, wherein the controller is electrically coupled to the limit switch.

6. The plunger pump of claim 1, further comprising a lubricating fluid reservoir in fluid communication with the high pressure lubricating fluid pump.

7. The plunger pump of claim 1, further comprising a first pressure sensor disposed to measure a working fluid pressure at the high-pressure end of the packing assembly and a second pressure sensor disposed to measure lubricating fluid pressure at the low pressure end of the packing assembly.

8. The plunger pump of claim 1, further comprising a first pressure sensor disposed to measure a first fluid pressure at the high-pressure end of the packing assembly and a second pressure sensor disposed to measure a second fluid pressure at the low-pressure end of the packing assembly, wherein the first fluid is a working fluid and the second fluid is oil or grease.

9. The plunger pump of claim 1, wherein the packing assembly comprises at least one V-shaped packing ring, the V-shaped packing ring having a first leg and a second leg joined together at their rearward ends to form a concave side of the packing ring and a convex side of the packing ring.

10. The plunger pump of claim 9, wherein the packing assembly comprises a plurality of V-shaped packing rings abutting one another to form a packing ring stack.

11. The plunger pump of claim 10, wherein the packing assembly further comprises a header ring at the high-pressure end of the packing assembly and a hacking ring at the low-pressure end of the packing assembly, with one or more V-shaped packing rings between the header ring and the backing ring.

12. The plunger pump of claim 9, wherein the concave side of the packing ring faces the high-pressure end of the packing assembly and the convex side of the packing ring faces the low-pressure end of the packing assembly.

13. The plunger pump of claim wherein the controller is operably coupled to the lubricating fluid pump to intermittently inject the pressurized lubricating fluid at a pressure at least substantially equal to a pressure of a working fluid at the high-pressure end of the packing assembly.

14. A plunger pump for use with hydrocarbon wells, the plunger pump comprising:

a pump manifold having a working fluid inlet, a working fluid outlet, and an elongated bore formed in the pump manifold, the elongated bore having a first end and a second end, the first end of the bore in fluid communication with the working fluid inlet;

an elongated plunger having a first end and a second end, the plunger slidingly disposed within the bore so as to define an annulus between the bore and the plunger;

a packing assembly disposed in the annulus between the plunger and the bore, the packing assembly having a low-pressure end closest to the second end of the bore and a high-pressure end closest to the first end of the bore, the packing assembly comprising a plurality of V-shaped packing rings abutting one another to form a packing ring stack, each V-shaped packing ring having a first leg and a second leg joined together at their rearward ends to form a concave side of the packing ring and a convex side of the packing ring, wherein the concave side of the packing ring faces the high-pressure end of the packing assembly and the convex side of the packing ring faces the low-pressure end of the packing assembly;

a sensor disposed to measure a condition associated with the plunger:

a lubricating fluid port in fluid communication with the low-pressure end of the packing assembly;

a high pressure lubricating fluid pump in fluid communication with the lubricating fluid port; and a controller operably coupled to the sensor and to the lubricating fluid pump to intermittently initiate injection of pressurized lubricating fluid only during intervals corresponding to a suction stroke of the plunger.

15. The plunger pump of claim 14, wherein the sensor is selected of the group consisting of a pressure sensor, a position sensor and a limit switch associated with the plunger.

16. The plunger pump of claim 15, wherein the sensor is a pressure sensor arranged in a chamber defined in the pump manifold between the working fluid inlet and the working fluid outlet.

17. The plunger pump of claim 15, wherein the sensor is a position sensor disposed on the plunger to measure a relative position of the plunger with respect to the manifold.

18. The plunger pump of claim 14, wherein controller is electrically coupled to the sensor and the lubricating fluid pump.

19. The plunger pump of claim 14, further comprising, a gland nut coupled to the manifold to secure the packing assembly, the gland nut including a lubricating fluid duct in fluid communication with the lubricating fluid port.

20. The plunger pump of claim 19, wherein the gland nut is threaded to the manifold such that a longitudinal position of the gland nut is adjustable for adjusting a longitudinal compression of the packing assembly.

* * * * *